United States Patent [19]

Sainen et al.

[11] Patent Number: 4,488,580

[45] Date of Patent: Dec. 18, 1984

[54] AUTOMATIC METHOD AND APPARATUS FOR STOPPING LOOM ROTATION AT A CONSTANT CRANK ANGLE

[75] Inventors: Tsutomu Sainen; Yoshitaka Fujita, both of Ishikawa, Japan

[73] Assignee: Tsudakoma Kogyo Kabushiki Kaisha, Japan

[21] Appl. No.: 411,832

[22] Filed: Aug. 26, 1982

[30] Foreign Application Priority Data

Sep. 11, 1981 [JP] Japan ..... 56-144126

[51] Int. Cl.[3] ..... D03D 51/00; D03D 51/08

[52] U.S. Cl. ..... 139/336; 139/1 R

[58] Field of Search ..... 139/336, 1 R, 370.2, 139/370.1, 353

[56] References Cited

U.S. PATENT DOCUMENTS 4,362,190 12/1982 Arakawa ..... 139/336

4,364,002 12/1982 Suzuki et al. ..... 139/336 X

FOREIGN PATENT DOCUMENTS 48-3666 2/1973 Japan ..... 139/1 R 2085615 4/1982 United Kingdom ..... 139/336

*Primary Examiner*—James Kee Chi

*Attorney, Agent, or Firm*—Lerner, David, Littenberg, Krumholz & Mentlik

[57] ABSTRACT

For ideal stoppage of loom rotation at a constant crank angle, initiation of braking action on loom rotation is always automatically and properly timed on the basis of initial stop lag angle representative of the current braking function so that the resultant actual stop angle should match the preselected stop crank angle and, more preferably, the initial stop lag angle is renewed to cover gradual deterioration in the braking function.

6 Claims, 1 Drawing Figure

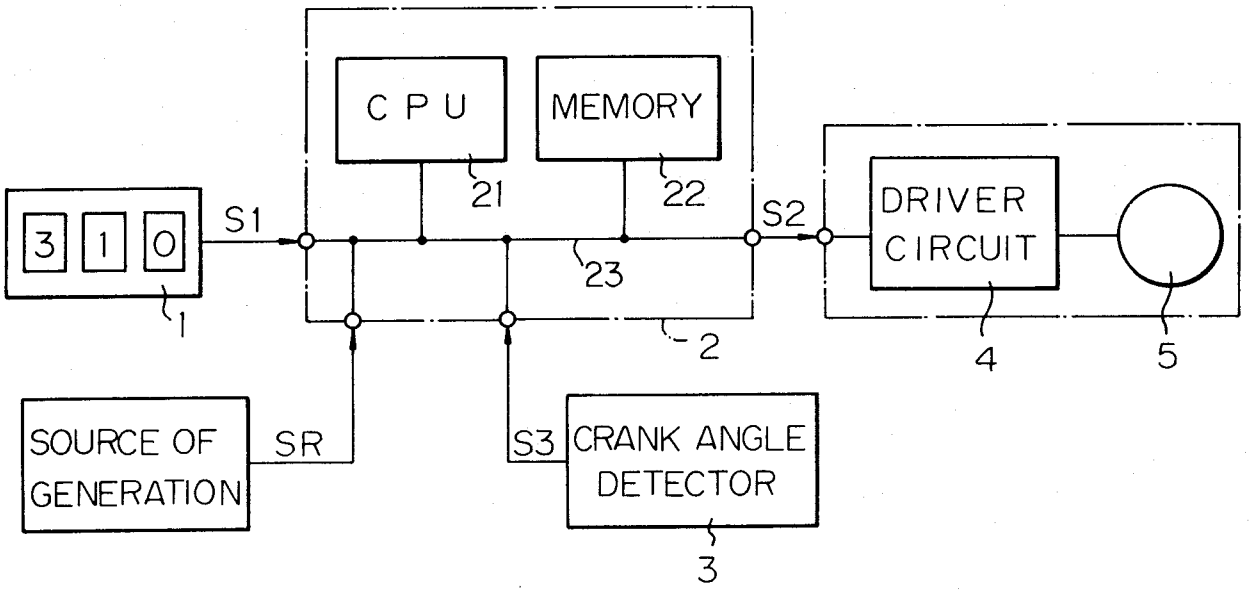
DRIVER CIRCUIT
5
4
S2
MEMORY
22
2
23
CRANK ANGLE DETECTOR
3
S3
CPU
21
SR
S1
3
1
0
1
SOURCE OF GENERATION

AUTOMATIC METHOD AND APPARATUS FOR STOPPING LOOM ROTATION AT A CONSTANT CRANK ANGLE

BACKGROUND OF THE INVENTION

The present invention relates to automatic method and apparatus for stopping loom rotation at a constant crank angle, and more particularly related to an automatic system which constantly enables correctly compensates stoppage of loom rotation regardless unavoidable variation in actual stop angle due to inertia and/or other factors.

Loom rotation has to be often stopped in case of operation troubles such as faulty weft insertion and warp breakage. Stoppage of loom rotation at incorrect crank angles often disenables easy cloth-fell observation by operators and timed termination of sub-nozzle ejection. In order to avoid such troubles, it is in general employed in the field to predetermine an optimum stop crank angle for each operation trouble to be expected and to cease loom rotation at such a predetermined stop crank angle in case of the operation trouble. More specifically, a stop signal is generated at a predetermined moment in order to cancel power supply to the drive motor of the loom and initiate braking action on the loom rotation.

It is well known that a loom continues its rotation for a while before complete stop even after the braking action has been initiated. In addition, braking action in general deteriorates after long use due to abrasion and oil contamination, and/or variates from time to time depending on the environmental conditions. Even when initiation of braking action is well timed to generation of the stop signal, actual stop angle of loom rotation variates from time to time or changes in long use.

In order to avoid troubles to be caused by such variation or change in actual stop angle, it is generally employed at factories for operators to properly adjust the moment of stop signal generation on the basis of the actual stop angle every time the actual stop angle falls off the initially selected stop crank angle. Further, braking function in practice varies from loom to loom even when same type of looms are used in a factory. Therefore, even when a common stop crank angle is set for a number of loom, different looms in practice have different actual stop angles. This inter-loom variation in actual stop angle forces the operators to individually adjust the moment of stop signal generation, i.e. the moment of braking action initiation, from loom to loom in reference to the result of actual stop angle observation.

SUMMARY OF THE INVENTION

It is the object of the present invention to enable stoppage of loom rotation constantly at a selected stop crank angle whilst properly renewing the stop crank angle in reference to variation or change in actual stop angle.

In accordance with the basic aspect of the present invention, a stop crank angle selected at a setter is compared with an initial stop lag angle reserved at a memory by operation of a central processing unit which, upon receipt of every stop demand signal, generates a stop signal at a moment fixed by the comparison and, when an actual stop angle deviates from the selected stop crank angle, renew the stop lag angle to a secondary value in accordance with the deviation.

BRIEF DESCRIPTION OF THE DRAWING

The attached drawing is a circuit diagram of one embodiment of the apparatus in accordance with the present invention.

DESCRIPTION OF THE PREFERRED EMBODIMENTS

In the drawing attached, the apparatus in accordance with the present invention includes a setter 1 for setting a stop crank angle for the loom which is given in the form of a digital setter in the case of the illustrated embodiment. Preferably, the setter 1 should have, as shown in the illustration, visible indication of the stop crank angle which was selected for easy adjustment by the operator. Once a stop crank angle is selected, the setter 1 puts out a stop position signal S1 which is, for example, binary coded, and corresponds to the selected stop crank angle. In the case of the illustrated example, the stop crank angle is set to 310 degrees.

The setter 2 is connected to a control circuit 1 which includes a central processing unit 21, a memory 22 and a data bus 23 connected to these elements. The memory 22 includes a programme reservoir which stores operation programme for the central processing unit 21, and a data reservoir which stores various data.

A crank angle detector 3 is connected to the control circuit 2. This crank angle detector 3 is given in the form of, for example, an absolute shaft encoder mounted to the crank shaft of the loom and puts out a series of crank angle signals S3 as the loom rotates, each of which is binary coded and corresponds to the current crank angle at the moment of its detection. The series of crank angle signals S3 are passed in sequence to the control circuit 2.

Stop demand signals SR are also passed to the control circuit 2 from their sources of generation which in general take the form of sensors for detecting mulfanction of the loom. For example, detection of weft breakage causes the weft sensor to generate a stop demand signal SR. Upon receipt of each stop demand signal SR, the control circuit 2 generates stop signal S2 at a prescribed moment which is then passed to a driver circuit 4 connected to the output side of the control clrcuit 2. Every time a stop signal S2 is put in, the driver circuit 4 cancels power supply to the drive motor (not shown) for the loom and, concurrently, activates an electro-magnetic brake 5 connected thereto. With a certain time-lag after activation of the electro-magnetic brake 5, the loom comes to a complete stop due to its inertia.

With the above-described construction, the apparatus of this embodiment operates as follows. Operation of the central processing unit 21 is controlled in accordance with the programme stored at the programme reservoir of the memory 21 in the control circuit 2. As a preparation, the angular interval between activation of the electro-magnetic brake 5 and the complete stop of the loom is measured in practice. This angular interval is termed as "the initial stop lag angle" and this initial stop lag angle, e.g. 250 degrees, is stored at the data reservoir of the memory 22 before initiation of the control operation.

When some operational trouble such as faulty weft insertion occurs on the loom, a stop demand signal SR is generated at a corresponding sensor (not shown) and passed to the control circuit 2. Upon receipt of this stop demand signal SR, the central processing unit 21 reads in, via the data bus 23, the stop position signal S1 selected at the setter 1. The central processing unit 21 also reads in the initial stop lag angle stored at the data reservoir of the memory 22. From these information, the central processing unit 21 calculates the difference between the stop crank angle represented by the stop position signal S1 and the initial stop lag angle from the memory 22. In the exemplified case, the stop crank angle set at the setter 1 is equal to 310 degrees, the initial stop lag angle stored at the memory 22 is equal to 250 degrees, and the calculated difference is equal to 60 degrees. The current crank angle of the loom is from moment to moment detected by the crank angle detector 3 and a corresponding crank angle signal S3 is passed to the control circuit 2 every moment. Thus, the control circuit 2 generates stop signal S2 the moment the current crank angle becomes equal to the difference, i.e. 60 degrees in the case of the above described example. This stop signal S2 is immediately passed to the driver circuit 4 for braking action. The above-described calculation may be completed before input of the stop demand signals from their sources of generation.

This stop signal S2 from the driver circuit 4 activates the electro-magnetic brake 5 to start the braking action on rotation of the loom. Now it is assumed that the loom has come to a complete stop at 280 degrees despite the initial set at 310 degrees in the above-described example. This actual stop crank angle is sensed by the crank angle detector 3 and a corresponding crank angle signal S3 (representative of 280 degrees) is instantly passed to the control circuit 2, and the central processing unit 21 takes up comparison of the actual stop angle (280 degrees) with the selected stop crank angle (310 degrees) at the setter 1.

Complete stop of loom rotation can be sensed in various ways. A conventional speed detector may be attached to the crank shaft of the loom so that it should generate a proper signal at zero loom rotation. Alternatively, the crank angle detector 3 per se may be used as a sort of speed detector since it generates a constant crank angle signal after the loom rotation has stopped.

Anyway, the loom has come to a complete stop at a crank angle 30 degrees ahead of the selected stop crank angle, i.e. 310 degrees. In order to cover this gap, the central processing unit 21 judges that output of the stop signal S2 from the control circuit 2 should be delayed for a period corresponding to 30 degrees crank angle interval. On the basis of this judgement, the central processing unit 21 carries out deduction of 30 degrees from the initial stop lag angle (250 degrees) and fixes the result of this reduction (220 degrees) as "the secondary stop lag angle" which is then passed to the memory 22 for storage. In this case, the initial stop lag angle in the memory 22 may be replaced by the secondary stop lag angle when required.

After the case of the first trouble on the loom has been removed, the loom restarts its rotation. It is assumed that the second trouble occurs in this reiterate rotation. Then the central processing unit 21 calculates the difference between the stop crank angle (310 degrees) represented by the stop position signal S1 and the secondary stop lag angle (220 degrees) newly stored at the memory 22. Thus the difference is found to be equal to 90 degrees. As a consequence, the control signal generates a stop signal S2 the moment the current crank angle becomes equal to 90 degrees.

In the manner described above, the actual stop angle of the loom is compared with the selected stop crank angle at the setter 1 and at every stop of loom rotation, and the moment of the next output of the stop signal S2 from the control circuit 2 is adjust in reference to the result of the comparison.

In the case of the foregoing embodiment, the output from the setter 1, i.e. the stop position signal S1 is read in by the central processing unit 21 upon receipt of every stop demand signal SR for comparison of the stop crank angle represented by the stop position signal S1 with the actual stop angle sensed by the crank angle detector 3, thereby adjusting the moment of generation of a corresponding stop signal S3.

As an alternative, however, the stop position signal S1 may be first reserved, via the data bus 23, at the memory 22 as a stop position information which is read out by the central processing unit 21 in advance to or upon receipt of every stop demand signal in order to fix the moment of stop signal generation. In addition to the digital type mentioned above, the setter 1 may take the form of a keyboard arrangement or a conventional separate memory.

Stop demand signals are put in the control circuit 2 in the case of the above-described embodiment. Alternatively, the control circuit 2 and the sources of generation of the stop demand signals may be connected to a common AND-gate. In this case, the control circuit 2 generates the stop signal once in one cycle loom rotation and the AND-gate generates a corresponding signal only upon receipt of the stop command signal.

Further, the control circuit 2 may be composed of comparators, adders, substractors and memories.

In the case of the above-described embodiment, actual stop angle is sensed by the crank angle detector 3 at every stoppage of loom rotation and this information is used for renewing the stop lag angle reserved at the memory 22. In connection with this operation, however, it is rather redundant in practice to reiterate such renewal at every stoppage of loom rotation since function lowering and oil contamination of the brake unit usually develope rather slowly. Under such a condition, it is rather practice to effect the renewal once in several cycles of loom rotation. Further, due to gradual development in deviation of stop angle caused by fatigue of the brake unit, stop angle at a certain stoppage of loom rotation is larger than that at the preceding stoppage of loom rotation. Consequently, renewal of the stop lag angle information in the control circuit may be carried out by estimating the stop angle at a certain stoppage of loom rotation from that at a stoppage of loom rotation of several times ago.

In the system of the above described embodiment, a stop crank angle is registered at the control circuit 2 and renewed in accordance with the actual stop angle in order to adjust the output moment of the stop signal from the control circuit 2. As an alternative, the output moment of the last stop signal may be stored at the control circuit 2. In this case, the difference between the stop crank angle selected at the setter 1 and the actual stop angle is calculated and the output moment of the next stop signal is adjusted in accordance with this difference. Adjustment of the output moment of the stop signals may be carried out once for either every stoppage or several stoppages of loom rotation. Adjustment may further be carried out on the basis of the output moment of several times ago.

As is clear from the foregoing, the output moment of a stop signal is always automatically adjusted in accordance with the difference between the selected stop crank angle and the actual stop angle. In other words, change in function of the braking unit even after long use can be automatically compensated in order to initiate the braking action always at an optimum moment, thereby assuring constant stoppage of loom rotation correctly at the selected angular position. This enables easy observation of the cloth-fell by operators when some trouble starts on the loom. Redundant ejection of air by sub-nozzles can be avoided too in order to prevent waste of energy.

For initial stop crank angle setting, a standard value common to looms of same type may be used therefor and no manual setting of stop crank angles from loom to loom is required, thereby greatly simplifying the setting operation. Such a collective setting of the stop crank angle is highly time-saving too.

Constant and automatic renewal of the moment for initiating braking action successfully avoids troubles encountered in the prior art in which gradually accumulated deviation in stop angle cannot the located until some trouble starts on the loom causing stoppage of loom rotation.

We claim:

1. Automatic method for stopping loom rotation at a constant crank angle comprising the steps of forming selected stop angle which represents a stop angle selected depending on a given process condition, reserving an initial brake lag angle fixed by field observation, calculating an initial brake start angle by subtraction between the value of said selected stop angle signal and said initial brake lag angle, detecting constantly current crank angle during said loom rotation to generate a series of current angle signals, issuing a stop signal for initiating braking action on said loom rotation, every time a stop demand signal is generated, at a moment when the value of said current angle signal becomes equal to said initial brake start angle, calculating a revised brake lag angle by subtraction between an actual stop angle and said initial brake start angle at stoppage of said loom rotation caused by brake action, and renewing said initial brake lag angle to said revised brake lag angle.

2. Automatic method as claimed in claim 1 further comprising calculating a revised brake start angle by subtraction between the value of said selected stop angle signal and said revised brake lag angle.

3. Automatic apparatus for stopping loom rotation at a constant crank angle comprising a setter for generating a selected stop angle signal, a crank angle detector for constantly sensing current crank angle during said loom rotation and generative of a series of current angle signals, at least one source of generation for generating a stop demand signal upon every occurrence of operational troubles on the loom which causes stoppage of said loom rotation, a control circuit connected, on its input side, to said setter, crank angle detector and source of generation of said stop demand signal, and generative of a stop signal every time said stop demand signal is generated, said control circuit reserving an initial brake lag angle and calculating an initial brake start angle by subtraction between the value of said selected stop angle signal from said setter and said reserved initial brake lag angle, said control circuit generating said stop signal at a moment when said current angle signal from said crank angle detector becomes equal to said initial brake start angle, said control circuit further calculating a revised brake lag angle by subtraction between an actual stop angle of the loom and said initial brake start angle, and renewing said initial brake lag angle reserved therein to said revised brake lag angle, and a brake unit connected to the output side of said control circuit and applying a braking action on said loom rotation upon receipt of said stop signal from said control circuit.

4. Automatic apparatus as claimed in claim 3 in which said control circuit further calculates a revised brake start angle by subtraction between the value of said selected stop angle signal from said setter and the revised brake lag angle.

5. Automatic apparatus as claimed in claim 3 or 4 in which said control circuit includes a central processing unit and a memory connected to each other, said initial brake lag angle is reserved at said memory, and said central processing unit is connected to said sources of generation of stop demand signal in order to generate said stop signal every time said stop demand signal is put in.

6. Automatic apparatus as claimed in claim 3 or 4 in which said control circuit includes a central processing unit, a memory connected to said central processing unit, and an AND-gate connected to the output side of said central processing unit, said initial brake lag angle is reserved at said memory, the input side of said AND-gate is connected to the output side of said central processing unit and said sources of generation of stop demand signal and said central processing unit generates said stop signal once in one cycle loom rotation.

* * * * *